United States Patent [19]

Bassetti

[11] Patent Number: 4,495,233

[45] Date of Patent: Jan. 22, 1985

[54] REMOVABLE COVER ADAPTED TO COVER THREE-DIMENSIONAL ARTICLES

[75] Inventor: Piero Bassetti, Milan, Italy

[73] Assignee: Bassetti, S.p.A., Milan, Italy

[21] Appl. No.: 576,319

[22] Filed: Feb. 2, 1984

[30] Foreign Application Priority Data

Feb. 14, 1983 [IT] Italy ..... 20800/83 [U]

[51] Int. Cl.[3] ..... B32B 3/06

[52] U.S. Cl. ..... 428/81; 428/99; 428/102; 428/126; 428/193; 5/496; 5/499

[58] Field of Search ..... 428/99, 192, 193, 123, 428/126, 81, 102; 5/499, 495, 496, 497, 500; 52/3

[56] References Cited

U.S. PATENT DOCUMENTS 1,359,526 11/1920 Ray ..... 5/499

3,295,577 1/1967 Danielson ..... 428/100 X

*Primary Examiner*—Alexander S. Thomas

*Attorney, Agent, or Firm*—Morgan, Finnegan, Pine, Foley & Lee

[57] ABSTRACT

The present invention relates to a cover made of fabric, non-woven fabric, knitted fabric or needle-worked fabric, for covering and dressing 3-D articles in a perfectly enwrapping manner and with great ease of application. The said cover features on two end flaps of two opposed sides a hemming of said flaps which forms a slide-seating within which corrugating elements are placed, each of the two free flaps of said cover also featuring two eyelets adapted to receive said corrugating elements.

5 Claims, 4 Drawing Figures

REMOVABLE COVER ADAPTED TO COVER THREE-DIMENSIONAL ARTICLES

The present invention relates to a cover made of fabric, non-woven fabric, knitted fabric or needle-worked fabric, for covering and dressing 3-D articles in a perfectly enwrapping manner and with great ease of application. Once removed from the article, the said cover resumes its absolutely flat configuration, in that the corrugating elements with which it is provided re-enter their respective seatings.

There are known covers obtained from pieces cut at the corners so as to form four borders disposed one on each side and such that, when the adjacent edges thereof are transversally sewn, a cover of essentially parallelepiped shape is formed.

Perimetrically sewn cuffs receive either elastic elements or non-elastic cords, essentially at the corners, adapted to permit the stable application of said parallelpiped cover onto the article.

A cover or sheet of such kind gives rise to problems both during realization and storage and in the phase of domestic or industrial maintenance.

The object of the present invention is to solve said problems by embodying a cover, if possible by means of a continuous industrial process, which, in addition to possessing optimal characteristics of applicability and stability of anchorage to the articles, has the further advantage of permitting ready maintenance domestically and also industrially with automated machines.

To attain the said object, the present invention embodies a cover made of a piece of fabric or non-woven fabric essentially polygonal in shape, adapted to enwrap 3-D articles, characterized by the fact the said cover features on end flaps of two opposed sides a hemming of said flaps which forms a slide-seating within which corrugating elements are placed; moreover, each of the two free flaps of said cover features at least two eyelets adapted to receive said corrugating elements.

The structural and functional characteristics and the advantages of a cover embodied according to the innovative concepts of the present invention will be more clearly understood from the following description and from the attached drawings, in which.

Figure 1:
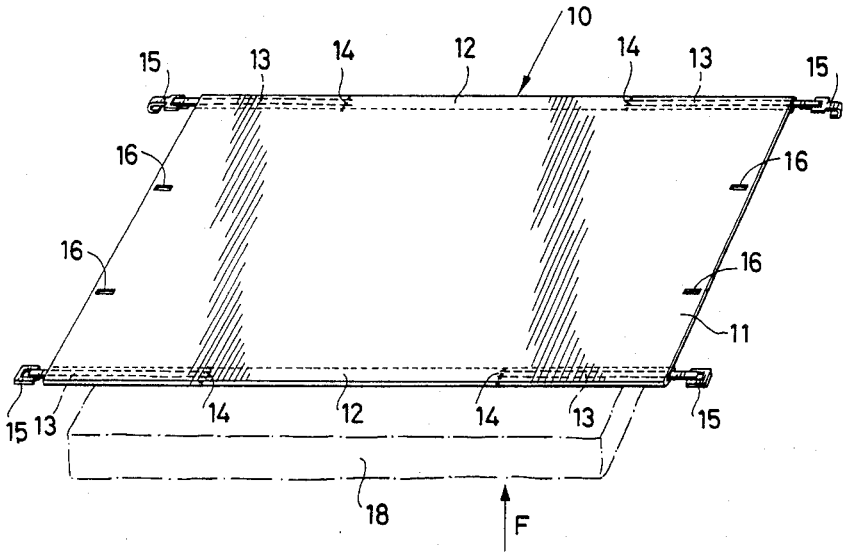
FIG. 1 is a perspective view on one plane of a sheet embodied according to the invention, laid on a mattress.

With reference to the drawings, a cover embodied according to the invention, in particular a sheet indicated overall by 10, consists of a piece 11 of fabric, non-woven fabric, knitted fabric, needle-worked fabric, etc., essentially polygonal in form, generally rectangular or square.

A pair of hems 12 on two opposed sides of said sheet 10 form slide-seatings in the fabric for corrugating elements 13, for example elastic elements, non-elastic strips or cords, or elements in two parts, one rigid and on elastic.

One end of said elements is fixed at 14 within the hemming 12, while the other end protruding from the hemming 12 carries a hook 15 or other retention means.

Figure 2:
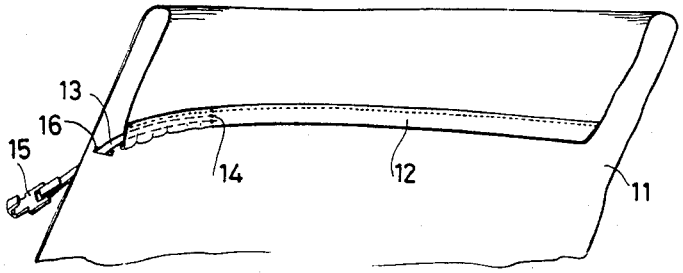
FIGS. 2 and 3 are a partial illustration of the phases of preparing said sheet for application to a mattress.

The two free sides of the piece feature a pair of eyelets 16 within which both the retention elements 15 and the corrugating elements 13 (FIG. 2) can pass.

Figure 4:
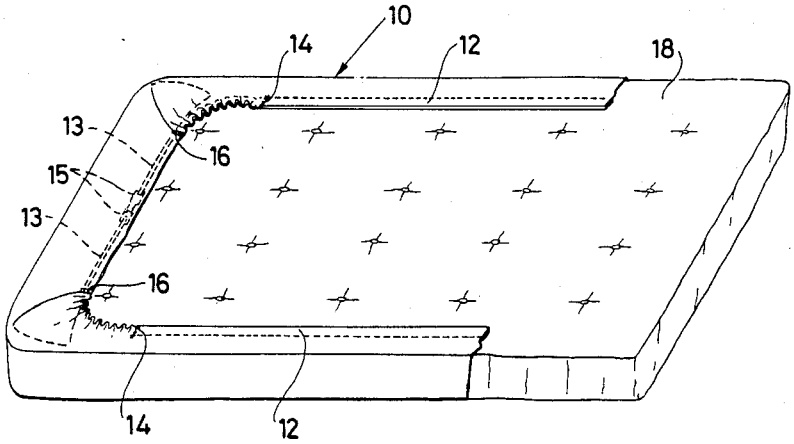
FIG. 4 is a partial view in the direction of the arrow F of FIG. 1 of said sheet applied to the mattress.

The connection of retention means 15 emerging on the same side from hems 12 of opposed sides causes the corrugating elements 13 to be tautened and the formation of a double-flapped pinna 17 at the corners of the piece 11. FIG. 4 shows a sheet 10 embodied according to the present invention, applied to a mattress 18.

A preferred manner of applying a sheet according to the invention to a mattress is the following:

the sheet 10 is disposed and appears as shown in FIG. 1 on a mattress 18, i.e. with the hemmed portions 12 disposed towards the mattress 18. The end flaps of the sheet 10 which bear the hemmed portions 12 are folded back over the sheet so as to bring the hooks 15 into line with the eyelets 16, both on one side and on the other.

Figure 3:
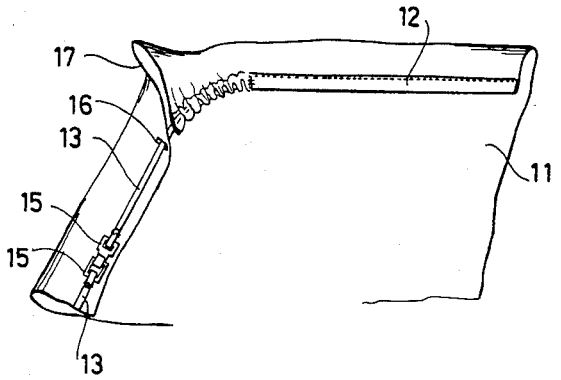

After latching the hooks 15 onto the eyelets 16 (FIG. 2), opposed hooks 15, disposed along one and the same free side of the sheet 10, are joined, placing the corrugating elements 13 in tension and forming double-flapped pinnas 17 (FIG. 3). The sheet 10 prepared in the manner described is now applied to and fitted over the mattress 18, turning over the zones where the corrugating elements 13 were hooked.

The double-flapped pinnas 17 are retained within the thus formed sheet, as also the zone where the two hooks 15 are located, and the mattress 18 proves perfectly enwrapped by the sheet 10 in snug-fit relationship thereto, as can be seen in the bottom view of FIG. 4.

When the sheet 10 has served its purpose it can be readily removed by means of the hooks 15 and, after sliding out the corrugating elements 13 from the eyelets 16 and allowing them to re-enter the hemmed portions 12, the sheet becomes absolutely flat again.

I claim:

1. A cover made of a piece of fabric or non-woven fabric essentially polygonal in shape, adapted to enwrap 3-D articles, characterized by the fact that it features on two end flaps of two opposed sides a hemming of said flaps which forms a slide-seating within which corrugating elements are placed, each of the two free flaps of said cover also featuring two eyelets adapted to receive said corrugating elements.

2. A cover according to claim 1, characterized by the fact that said corrugating elements bear at their ends reciprocal retention elements.

3. A cover according to claim 1, characterized by the fact that said corrugating elements are elastic.

4. A cover according to claim 1, characterized by the fact that said corrugating elements consist of an elastic portion and a rigid portion.

5. A cover according to claim 1, characterized by the fact that said corrugating elements have one end fixed within said hemmed portion and one end protruding from the said hemmed portion and bearing reciprocal latching means with respect to a corresponding corrugating element.

* * * * *